United States Patent [19]

Tota et al.

[11] 4,264,395

[45] Apr. 28, 1981

[54] AUTOMATED GARMENT BAGGING SYSTEM

[75] Inventors: Kenneth P. Tota, Elmira; Charles M. Mowery, Jr., Elmira Heights; Edward D. Hubbard, Watkins Glen, all of N.Y.

[73] Assignee: The Reece Corp., Waltham, Mass.

[21] Appl. No.: 880,777

[22] Filed: Feb. 24, 1978

[51] Int. Cl.[3] ..... B65B 1/04; B32B 31/00

[52] U.S. Cl. ..... 156/359; 53/76; 53/241

[58] Field of Search ..... 156/359; 53/241, 256, 53/76, 52, 66

[56] References Cited

U.S. PATENT DOCUMENTS

| | | | |
|---|---|---|---|
| 2,639,566 | 5/1953 | Blessing | 53/241 UX |
| 3,284,987 | 11/1966 | Sigmon | 53/76 X |
| 3,449,887 | 6/1969 | Abramson | 53/76 |
| 3,755,984 | 9/1973 | Vanderpool | 53/256 X |
| 3,886,713 | 6/1975 | Mitchell et al. | 53/76 X |
| 3,895,480 | 7/1975 | Lombardo | 53/256 |
| 4,082,596 | 4/1978 | Vanderpool | 53/241 X |

*Primary Examiner*—David A. Simmons

*Attorney, Agent, or Firm*—Charles S. McGuire

[57] ABSTRACT

A method and apparatus for bagging a garment which is supported on a hanger wherein the bag is closed at both the upper and lower ends. The bag is placed or formed about the garment and the upper end, through which the hook extends, is closed with the hanger supported at a first station. The bagged garment is then moved to a second station where the lower end of the bag is sealed. The method and apparatus are disclosed in preferred embodiments wherein the entire bagging operation, including bottom sealing, is carried out in a completely automated manner.

20 Claims, 10 Drawing Figures

AUTOMATED GARMENT BAGGING SYSTEM

BACKGROUND OF THE INVENTION

The present invention relates to forming or placing bags of polyethylene or similar heat-sealable material about garments arranged on conventional hangers. More specifically, the invention pertains to novel methods and apparatus for bagging hanger supported garments wherein the bags are closed at the sides and at both the upper and lower ends.

Many forms of apparatus have been proposed for bagging hanger-held garments in heat sealable polyethylene bags. In a popular type of such apparatus, the bags are formed by drawing the open end of a continuous web of the material, supplied in tubular form, over the hanger and garment until the latter is completely covered and then sealing and cutting the web above the hanger with the hook end extending through the sealed end of the bag. The operation may be carried out in manual, semi automatic or fully automatic fashion.

While the lower end of the bag, i.e., the end opposite that through which the hanger extends, is usually left open, it is often desirable to close the bag on all sides in order to provide more complete protection for the garment. Certain types of bagging apparatus, e.g., that disclosed in U.S. Pat. No. 3,895,480, have been provided with means for sealing both ends of individual bags formed from a continuous roll of tubular stock about a hanger-held garment. However, as a practical matter, such means must be built into the apparatus at the time it is constructed and cannot conveniently be added at a later time. Furthermore, since the bottom sealing mechanism operates in conjunction with the rest of the bagging apparatus, it is necessary that the lower ends of all bags formed on such apparatus be sealed, although in some instances it may be unnecessary or undesirable to close the lower end. Also, such bottom sealing apparatus cannot conveniently be incorporated in bagging machines wherein the hanger is supported on the upper end of a pole since the bagging material surrounds the pole as well as the garment until the hanger is removed from the pole. Thus, it is difficult or impractical to incorporate bottom sealing means directly with one of the most popular forms of garment bagging apparatus.

It is a principal object of the present invention to provide a method and apparatus for bagging hanger-held garments wherein the garment is enclosed in a bag sealed at both ends, with the bag initially being placed over the garment and sealed only at the end through which the hanger extends on any conventional bagging apparatus.

A further object is to provide a method of bagging garments suspended from hangers in a fully automated sequence of steps resulting in a bag completely enclosing the garment and closed at both ends as well as the sides.

Another object is to provide novel and improved apparatus for closing the lower end of a heat sealable bag which covers a hanger-supported garment with the hook end of the hanger extending through the sealed upper end of the bag.

A still further object is to provide apparatus of the aforementioned type with fully automatic operation including feeding hanger-held, bagged garments to the bottom sealer, effecting closure of the lower end below the lowest portion of the garment, and ejecting the garment and fully closed bag to a pick-up station.

Still another object is to provide apparatus having unique means for automatically sealing the end of a heat sealable unique means for automatically sealing the end of a heat sealable bag which covers a hanger-held garment at a predetermined location between the lowest portion of the garment and the edge of the bag.

Other objects will in part be obvious and will in part appear hereinafter.

BRIEF SUMMARY

In accordance with the foregoing objects, the invention contemplates a sequential method of bagging hanger-held garments which involves supporting the hanger at a first station and forming an individual bag, closed at the sides and upper end, about the garment and hanger in conventional fashion. The hanger is then removed from its support at the first station and moved to a supported position at a second station where the lower end of the bag is sealed in a location between the lowest portion of the garment and the lower edge of the bagging material. The hanger and garment with fully closed bag are then further transported to a third station for pick-up and distribution. The entire process is preferably carried out in a fully automated manner, requiring no human operators whatever other than for supervision.

The garments which have previously been enclosed by conventional means in polyethylene bags, closed at the sides and top and open at the bottom, are sequentially fed to a location where the hanger hook is engaged by a member attached to an endless conveyor chain. As the chain moves, the hanger and bagged garment are drawn along a predetermined path until the open, lower end of the bag reaches a position wherein the sealing means are located between the lowest portion of the garment and the lower edge of the bagging material. Sensing means, preferably electrical in nature but also disclosed in pneumatic form, actuate a clutch and brake in the drive system to halt movement of the conveyor chain, hanger and bagged garment with the lower end of the bag in the proper position.

The heat sealing elements are then actuated to engage and seal the lower end of the bag near the edge thereof. Upon retraction of the movable portions of the sealing mechanism, the drive system is again actuated to resume movement and carry the hanger and garment in the fully closed bag to a discharge point, as another bagged garment is moved by the chain into position for sealing the lower end.

DETAILED DESCRIPTION

Figure 1:
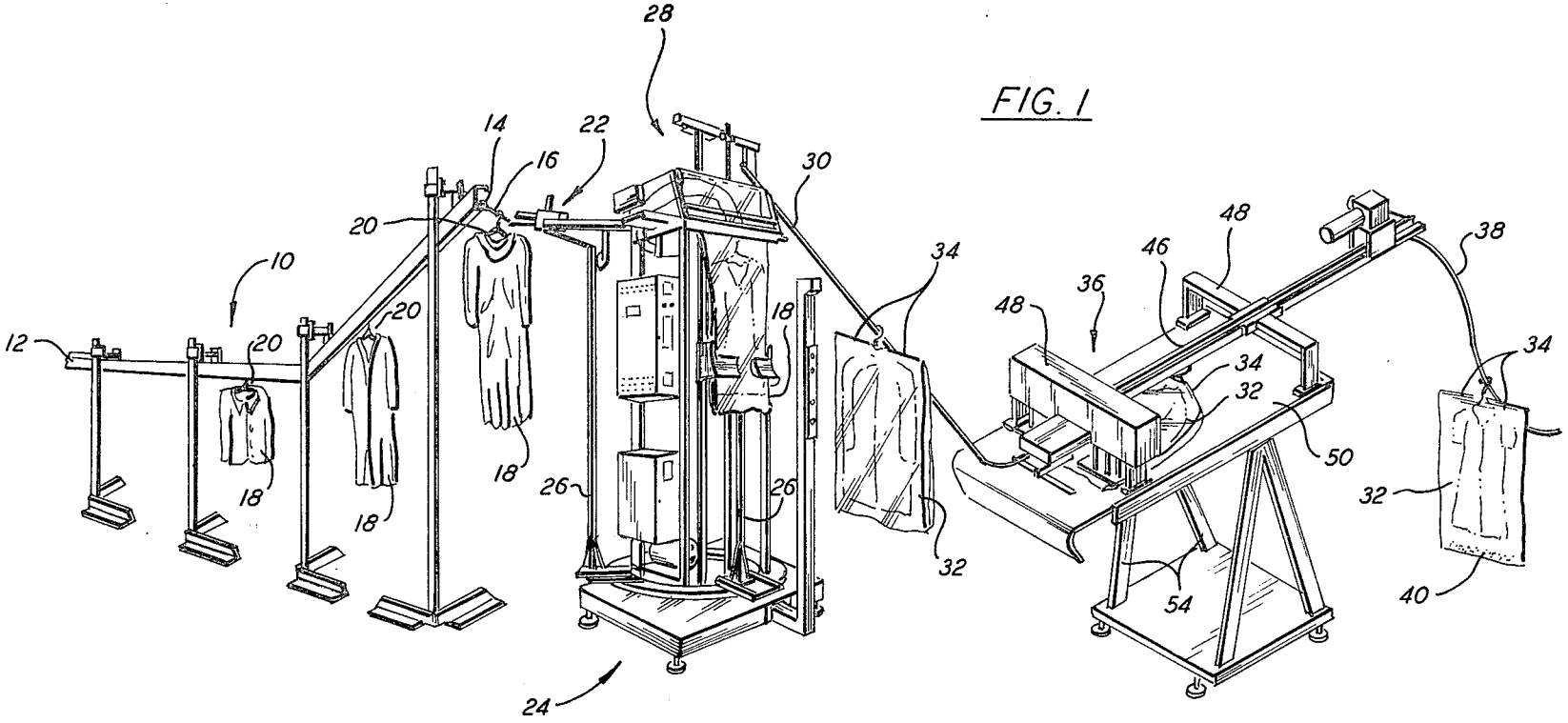
FIG. 1 is a perspective view showing the movement of hanger-held garments through all of the stations involved in the bagging method of the invention, and showing the major elements of apparatus employed in the preferred embodiments.
Figure 3:
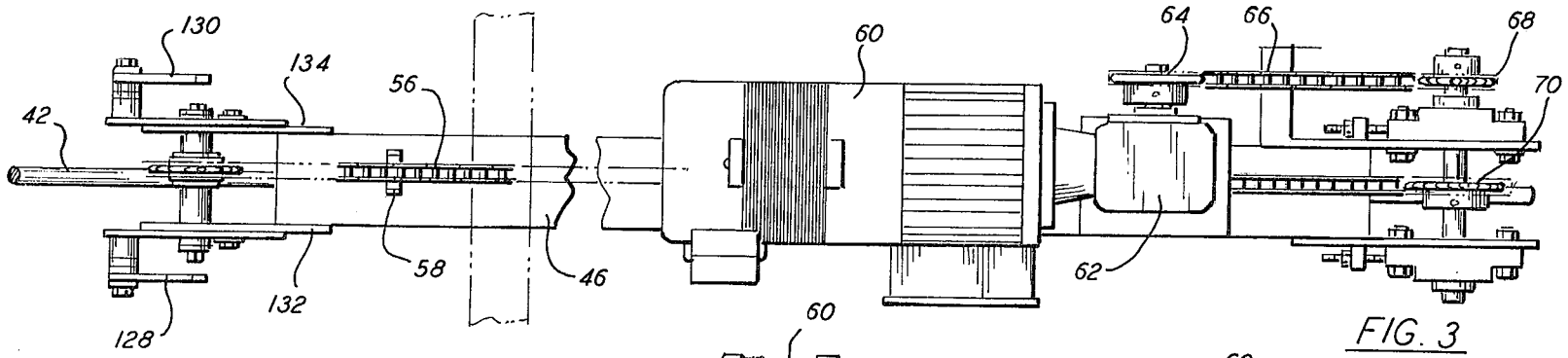
FIG. 3 is a top plan view of the elements shown in FIG. 2.

Referring now to the drawings, in FIG. 1 is seen an automatic conveyor system, denoted generally by reference numeral 10, adapted to receive at one end 12 the hooked ends of conventional garment hangers and move them linearly to the opposite end 14 from which they are discharged onto slide rail 16. Although details of construction of the conveyor system form no part of the present invention, a suitable example is that disclosed in U.S. Pat. No. 3,845,855. Several garments 18 are shown in FIG. 1, each suspended from an individual hanger 20, in various phases of the transportion and bagging process.

As hangers 20 are deposited on slide rail 16 they travel by gravity to sequential supply means 22, which includes stop means and an actuating mechanism for supplying one hanger at a time to automatic bagging apparatus denoted generally by reference numeral 24. Although the invention may be practiced in conjunction with any prior art bagging apparatus, where a bag is placed over a hanger-supported garment, being closed at the sides and upper end, through which the hanger hook extends, and open at the lower end, it is preferred that fully automated bagging apparatus be used in applications where the volume of bagging economically justifies such equipment. Bagging apparatus 24 shown in FIG. 1 is of the type commercially available from BMT Manufacturing Co. Inc., of Elmira, New York, and is more fully shown and described in U.S. Pat. No. 3,982,377 of Charles C. Vanderpool, entitled Automatic Bagging Machine.

Apparatus 24 includes three garment support poles 26 (two of which may be seen in FIG. 1) arranged at 120° intervals on a rotatable, circular base. As disclosed in aforementioned U.S. Pat. No. 3,982,377, the base is sequentially rotated in 120° increments so that poles 26 are positioned in turn at a loading station, a bagging station and an ejection station. At the loading station one of hangers 20 is placed by supply means 22 upon the pole. At the bagging station the leading, open end of a continuous web of tubular polyethylene is drawn downwardly over the pole, hanger and garment, sealed transversely in an area above the garment and hanger, with the hook extending through the central part of the seal, and severed from the remainder of the web just above the seal. At the ejection station, by means of mechanism 28, the hanger is lifted from the pole, elevated until the lower end of the bag clears the top of the pole, and deposited on slide rail 30.

Thus, as hangers 20 are deposited upon slide rail 30, garments 18 are covered by individual bags 32 which are sealed along the upper end, on each side of the hanger hook, as indicated at 34, and open at the lower end. Hangers 20 travel down slide rail 30 by gravity to a point where the hooks are engaged by a movable portion of bottom sealing apparatus, generally denoted by reference numeral 36 and described later in more detail. The hanger and bagged garment are moved along a predetermined path until the trailing edge of the bag reaches a predetermined position, which is automatically sensed in a manner also described later in more detail. At this point, movement is halted as heat sealing means operate to close the lower end of the bag. Upon completion of the heat sealing operation, movement of the hanger is resumed until the hooked end thereof is deposited on slide rail 38 for travel by gravity to a pick-up station.

At this point, garments 18 are fully enclosed in bags 32 which are sealed not only in areas 34 at the upper end but also in area 40 at the lower end, between the lowest portion of garment 18 and the lower edge of the bag. This enclosure of the garments in a fully sealed bag is carried out by bagging the garments at a first station in individual bags, closed at the sides and upper end and open at the lower end, moving the bagged garments to a second station where the lower end is sealed, and then further transporting the garments enclosed in the fully sealed bags to a third station for pick-up and delivery, etc.

Turning now to FIGS. 2–5, the structure and operation of the preferred embodiment of the bottom sealing apparatus of the invention is shown in more detail. Guide rail 42 is supported by brackets 44 which extend downwardly from fixed connections on conveyor frame 46. One end of rail 42 is positioned adjacent to, or forms a direct extension of, slide rail 30. The opposite end is likewise positioned adjacent or connected to slide rail 38, whereby the hooked ends of hangers 20 are transferred directly from rail 30 to rail 42 to rail 38.

Referring again briefly to FIG. 1, conveyor frame 46 is seen to be supported by frame means 48 which rest upon the marginal edges of a flat bed or plate 50 having curved end portion. Bed 50 is supported at an appropriate height above floor level by legs 54, or other such support means. Although bed 50 may be disposed in any desired plane, from horizontal to vertical, it is shown in the preferred attitude, at an acute angle to the horizontal.

Figure 4:
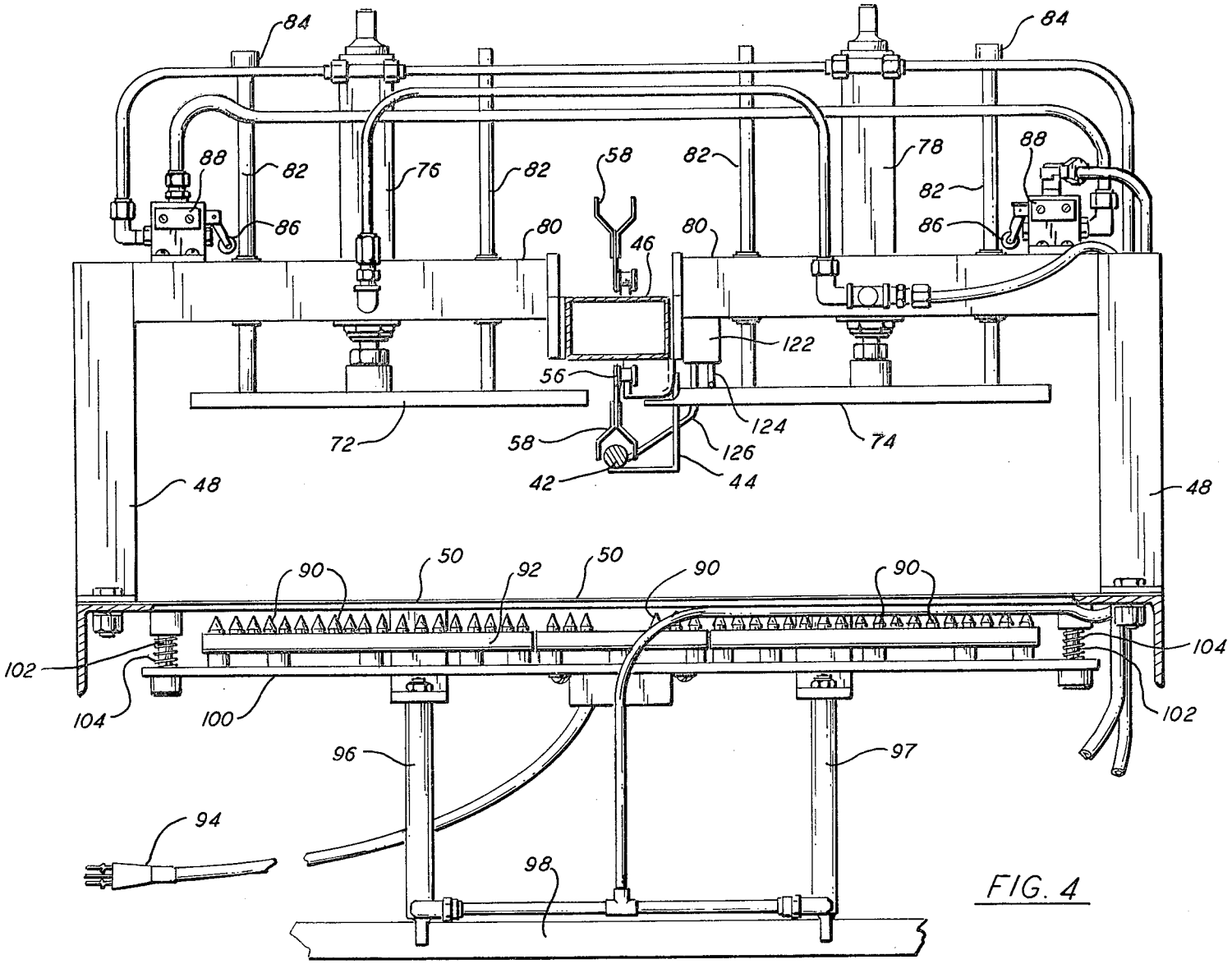
FIG. 4 is a front elevational view in section on the line 4—4 of FIG. 2.
Figure 5:
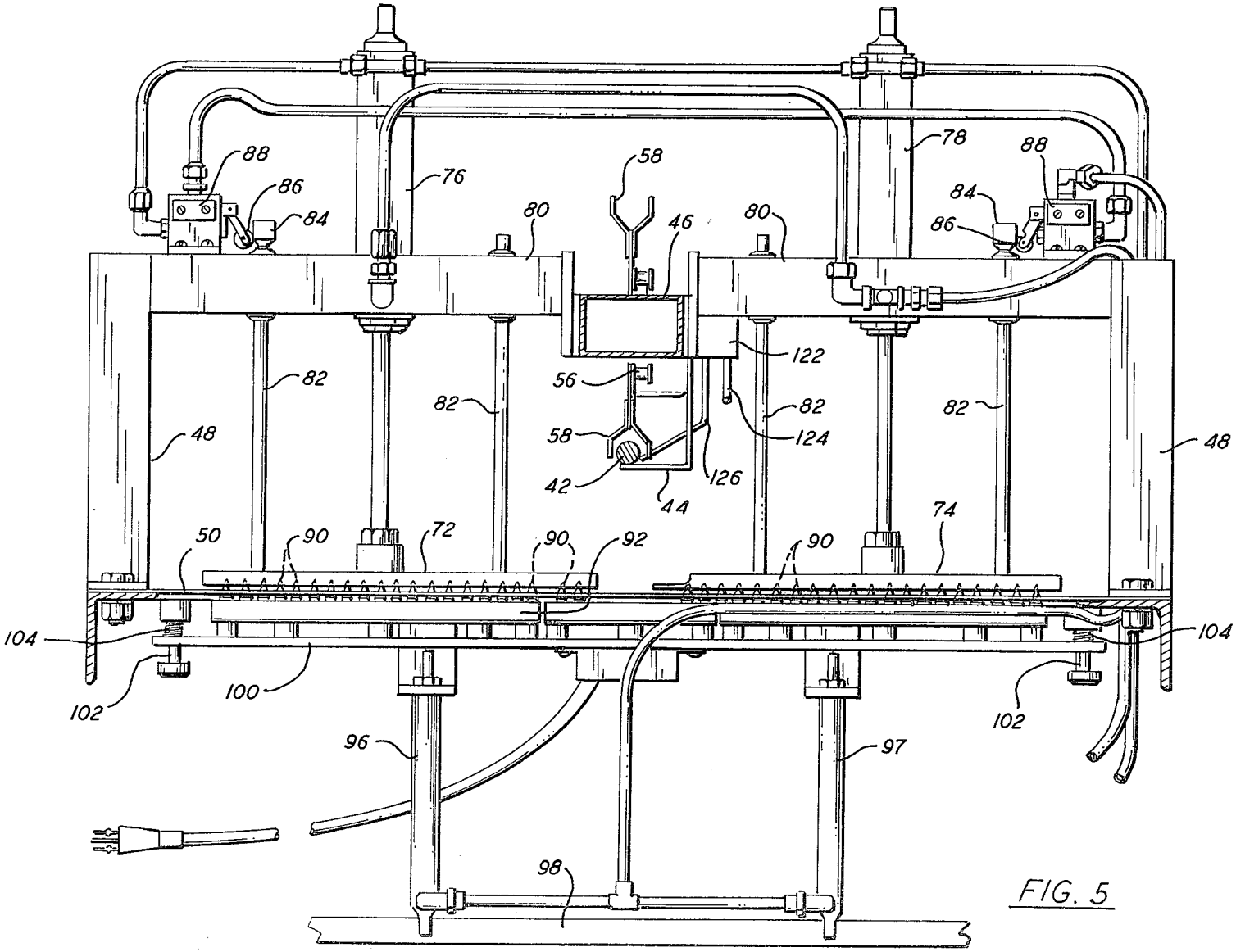
FIG. 5 is a front elevational view of certain elements of FIG. 4, shown in another position.

Conveyor frame 46, as seen in FIGS. 2–5, serves as a support and guide for endless conveyor chain 56, having rigidly attached to certain links thereof at spaced intervals fork assemblies 58. When traveling on the lower reach of chain 56, fork assemblies 58 straddle guide rail 42, as best seen in FIGS. 4 & 5, thus being constructed and arranged to engage and transport along rail 42 the hook ends of hangers 20 which are transferred to guide rail 42 from slide rail 30. Drive assembly 60, including an electric motor, clutch and brake, is supported above conveyor frame 46 and is connected through gear box 62 to drive sprocket 64. Chain 66 passes around drive sprocket 64 and driven sprocket 68, which is mounted on the same shaft and imparts rotation to sprocket 70 thereby moving conveyor chain 56 in response to driving engagement of drive assembly 60.

A pair of movable plate members 72 and 74 are attached to the ends of the reciprocating rods of pneumatic cylinders 76 and 78, which are supported on laterally extending portions 80 of frame means 48. Guide rods 82 are also attached to plates 72 and 74, and slidably pass through portions 80 of the frame to maintain movement of the plates linear as the air cylinders are operated. The outside pair of guide rods 82 carry collars 84 at their upper ends for engagement of movable followers 86 of poppet valves 88 which control the air supply for purposes described later.

The heat sealing means are mounted beneath bed 50 and include a plurality of conical prongs 90, arranged in a desired pattern upon plate 92. Plug 94 is connected to a source of electrical power to provide resistance heating of prongs 90. Pneumatic cylinders 96 and 97 are supported at their lower ends by fixed frame members 98, the ends of the movable piston rods being attached to support 100 for plate 92 for reciprocating movement thereof toward and away from bed 50. Support 100 is slidably mounted on guide pins 102 which are affixed to the lower side of bed 50. Springs 104 encircle pins 102 and bias support 100 away from bed 50. Air cylinders 96 and 97 are actuated to move support 100 and plate 92 toward bed 50 in response to actuation of poppet valves 88 by collars 84. Thus, when plates 72 and 74 complete their downward travel, in response to actuation in a manner described later, poppet valves 88 are actuated and air is supplied to the lower ends of cylinders 96 and 97 to move plate 92 toward bed 50. Both bed 50 and plates 72 and 74 are provided with openings in a pattern corresponding to that of prongs 90. When plate 100 contacts the lower side of bed 50, prongs 90 extend through the openings in bed 50 and are forced through the polyethylene material of bag 32 which is engaged betwen bed 50 and plates 72 and 74. The heat of the prongs effects a seal between the two layers of the bag in the areas surrounding each prong, the tips of which extend into the openings provided for such purpose in plates 72 and 74. The elements are in the positions shown in FIG. 5 at the time sealing occurs, with cylinders 76 and 78 and cylinders 96 and 97 at the outward limits of their travel. The heat sealing operation with a movable set of heated conical prongs which are forced through the material being sealed is essentially the same as that described in connection with the upper bag end sealing in aforementioned U.S. Pat. No. 3,982,377.

Figure 6:
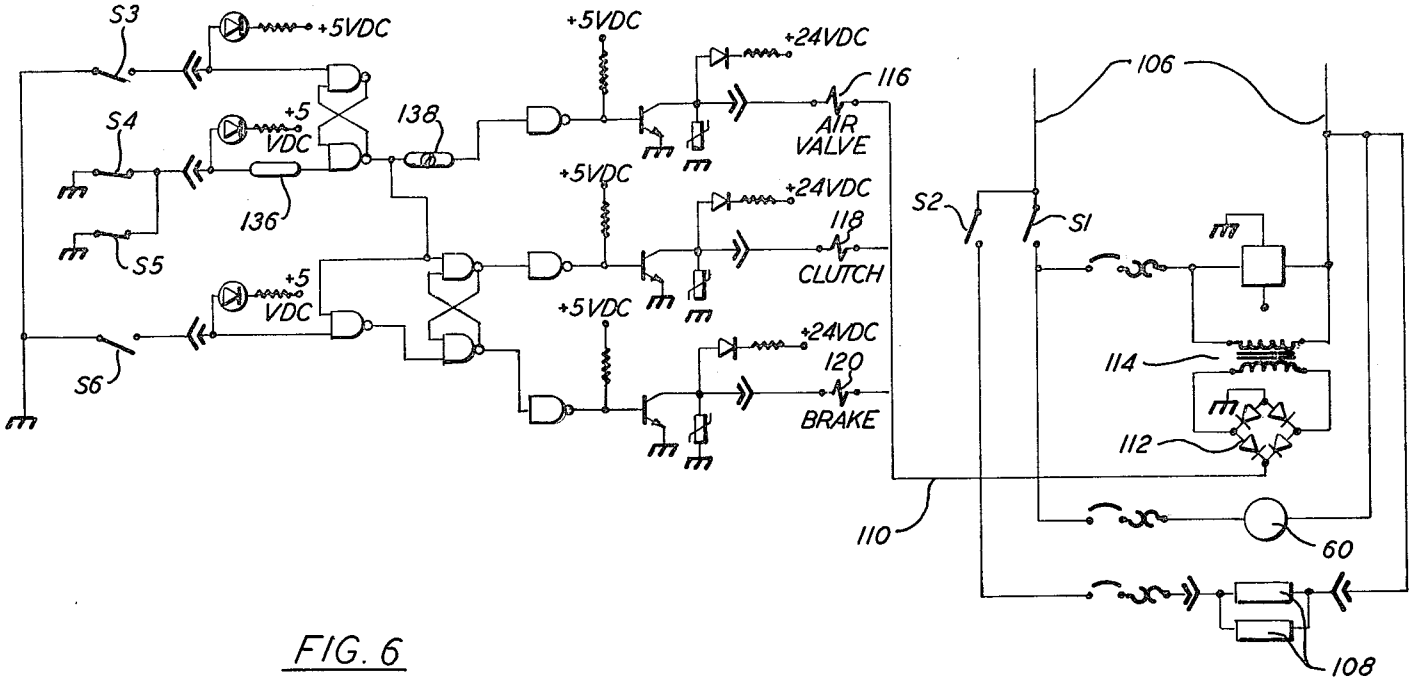
FIG. 6 is a schematic diagram of the electrical power and logic system which controls operation of the elements of FIGS. 2–5.

Operation of bottom sealing apparatus 36 may be more easily understood with reference to the schematic diagram of FIG. 6, taken with the preceding description of the physical elements. Leads 106 are connected across a 115 volt AC power source and are connected directly to motor 60 and heating elements 108 for prongs 90 through manually operable toggle switches S1 and S2, respectively. The remainder of the system is operated on DC, at appropriate voltage, provided on line 110 from rectifier 112 and transformer 114.

The elements which are electrically actuated by the circuit of FIG. 6 are connected in parallel to DC line 110; the solenoid operated valve which controls air supply to cylinders 76 and 78 is indicated by reference numeral 116, and the clutch and brake associated with conveyor drive motor 60 are denoted by numerals 118 and 120, respectively. Operation of the logic system which actuates the air valve, clutch and brake is controlled by four switches S3, S4, S5 and S6. Switches S3 and S6 are microswitches having contacts which are opened and closed by mechanical contact of movable portions of the mechanism with switch arms. Switches S4 and S5 are connected in parallel in the line between certain logic elements and their ground connection, whereby such elements are inoperative when both of switches S4 and S5 are open.

Figure 2:
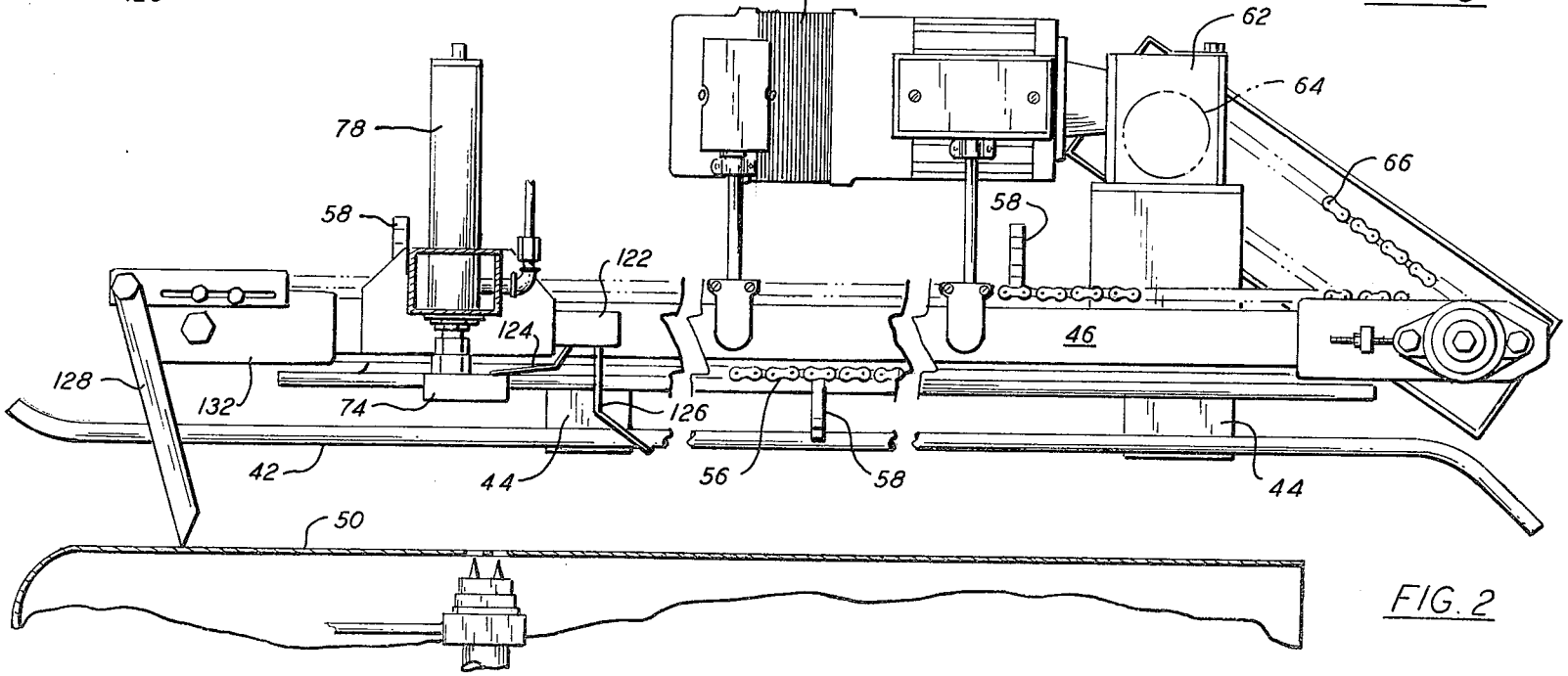
FIG. 2 is a side elevational view of a portion of the bottom sealer apparatus shown in FIG. 1.

Reference is again made to FIGS. 2–5 where the mechanical elements associated with switches S3–S6 are shown. Microswitches S3 and S6 are contained in box 122 which is mounted on one side of conveyor frame 46, or on other stationary portions of the apparatus. Movable arms 124 and 126 extend from box 122 and are connected to the electrical contacts therein which comprise switches S3 and S6. The free end of arm 124 is contacted and held in an elevated position by plate 74 when the latter is in its uppermost position, as shown in FIG. 4, thus maintaining switch S6 in the open position. When plate 74 moves downwardly, as cylinders 76 and 78 are extended, arm 124 may move to a lower position, shown in FIG. 5, which closes switch S6. The free end of arm 126 is positioned adjacent rail 42 and is moved upward by contact with a hanger hook each time one of fork assemblies 58 moves a hanger past arm 126, thereby closing the normally open switch S3. Rods 128 and 130 are mounted for freely pivoting movement upon support brackets 132 and 134, respectively, which are connected to the lower end of conveyor frame 46. As best seen in FIG. 2, the free end of rod 128 contacts bed 50, as does the free end of rod 130. Both rods 128 and 130 and bed 50 are made of electrically conducting material and the rods are connected in the electrical control circuit by appropriate wiring (not shown) to form switches S4 and S5. That is, contact of rods 128 and 130 with bed 50 forms the ground connection through either of switches S4 and S5 required for operation of the circuit of FIG. 6.

In operation, as motor 60 drives conveyor chain 56, fork assemblies 58 will engage the hook ends of hangers 20 which are delivered to the lower end of rail 30. As the hanger is pulled along rail 42, bag 32 which covers the garment on the hanger is drawn along the surface of bed 50, passing under the free ends of rods 128 and 130, thereby breaking the ground connection normally provided by the rods. That is, while the polyethylene material of the bag is positioned between rods 128 and 130 and the surface of bed 50, the rods are insulated from electrical contact with the bed and switches S4 and S5 are open.

The relative positions of switch arm 126 and rods 128 and 130 is such that arm 126 is contacted and moved by the hanger hook after the hanger has traveled a relatively short distance past rods 128 and 130. Thus, even in the case of short bags 32, the bag material will be present between bed 50 and rods 128 and 130 when arm 126 is contacted by the hanger hook. Accordingly, switches S4 and S5 are in the open position at the time switch S3 is closed by the travel of the conveyor.

Closure of switch S3 serves to reset the logic system after its preceding cycle of operation, but a new cycle cannot begin until the ground connection is re-established through switches S4 and S5. Thus, conveyor chain 56 continues to move until the lower end of bag 32 has passed at least one of rods 128 and 130 allowing switches S4 and S5 to close as the free ends of the rods contact bed 50. The establishment of the ground contacts provides an input to the logic system, whereby clutch 118 is disengaged and brake 120 is applied to remove motor 60 from driving engagement with conveyor chain 56 and to stop chain movement. The time between contact of rods 128 and 130 with bed 50 and actual stopping of chain 56 allows the lower end of the bag to travel from the location of rods 128 and 130 to the location where it is sealed, i.e., between plates 72 and 74 and prongs 90. Air valve 116 is also actuated by circuit operation to provide air to cylinders 76 and 78, thereby moving plates 72 and 74 downward and causing normally open switch S6 to close in order that clutch 118 remains disengaged and brake 120 continues to be applied to prevent movement of chain 56 as air valve 116 is again actuated to cause upward travel of plates 72 and 74.

As plates 72 and 74 reach the downward limit of their travel, engaging the bagging material near the lower end of the bag between the plates and bed 50, collars 84 contact followers 86 to actuate poppet valves 88 as previously mentioned. This provides pressurized air to extend cylinders 96 and 97, thereby moving support plate 100 upward. Prongs 90 extend through the openings in bed 50 and are forced through the bagging material and extend into the openings in plates 72 and 74. The lower end of the bag is thus effectively closed, being sealed in the areas around the small openings made by prongs 90.

Adjustable timer 138 provides a time delay between downward movement of plates 72 and 74 and the following actuation of air valve 116 to reverse the air supply to cylinders 76 and 78. The time delay is adjusted in accordance with the time required for mechanical movement of the sealing elements and the dwell time required to effect a satisfactory seal in accordance with the temperature of prongs 90, the type and thickness of the bagging material, etc. At the expiration of such time delay, air valve 116 is again actuated and plates 72 and 74 begin upward travel. As soon as collars 84 are moved out of contact with followers 86, poppet valves 88 are closed to remove the air supply from cylinders 96 and 97. Springs 104 will thereupon move support plate 100 and prongs 90 back to the position of FIG. 4.

As plates 72 and 74 reach their upper limit of travel, plate 74 again contacts and moves arm 124, opening switch S6. This allows the logic circuit to actuate the clutch and brake controls, thereby releasing brake 120 and engaging clutch 118. Motor 60 is again in driving engagement with conveyor chain 56, which resumes its movement to continue pulling the hanger along rail 42. At the upper end of the conveyor run hanger hook is deposited on slide rail 38 for movement of the garment in the fully sealed bag to the pick-up station. Continued movement of the conveyor will serve to pick up the next hanger from rail 30 and the sequence is repeated.

It will be noted that either of rods 128 and 130, or both, may be in contact with bed 50 in order to render the circuit active. By providing a pair of laterally spaced rods as opposed to a single rod for establishing the ground connection, operation of the sealing mechanism is initiated as soon as the trailing edge of the bag on either side passes one of the free ends of the rods. This insures that the entire lower end is sealed even though the trailing edge may be uneven or the bag inadvertently positioned at an angle to its direction of travel.

A second embodiment of the bottom sealing apparatus is shown in FIGS. 7–10, to which reference is now made. A succession of bagged, hanger supported garments are fed by gravity along slide rail 140 to a stop and sequential hanger supply means 142. This means may be identical to that used for supplying single hangers in a sequential manner to the automatic bagging machine of FIG. 1 and denoted therein by reference numeral 22. In this embodiment, as in the first, garments 144, supported on hangers 146, have been enclosed in bags 148, closed at the sides and upper end, before being positioned for supply to the bottom sealing apparatus.

Also as in the first embodiment, endless conveyor chain 150 is supported and guided by frame 152 which in turn is supported by frame means 154. In the present embodiment, the conveyor chain and supporting framework are vertically arranged. As chain 150 is driven by motor 155, having the usual clutch, brake and means for transmitting driving motion to chain 150, the hooks of hangers 146 are engaged by fingers 156 which are connected to and extend outwardly from chain 150. As the hangers are fed to the lower end of rail 140 the next succeeding finger 156 engages the hook as the finger travels around the lower end of the conveyor path, lifting the hanger and bagged garment for upward transport by the conveyor. Retainer rail 158 is supported adjacent conveyor chain 150 on the rear side (i.e., the side opposite that from which garments are supplied) to insure that hanger hooks carried by fingers 156 cannot slip off during upward travel.

Essentially flat plate 160 is supported between the lower portion of a pair of upright frame members 154. As the hooks of hangers 146 are transported upwardly by the conveyor, bags 148 which cover garments 144 on the hangers are drawn across the forwardly facing surface of plate 160. Aperture-forming member 162 is fastened to and extends forwardly from plate 160, surrounding an opening passing through the plate and communicating with tube 164. The material of bags 148 cover the aperture defined by member 162 as the hangers are moved upwardly until the lower end of the bag is moved past the aperture. This serves to open and close a pressure-responsive switch for purposes described later.

Figure 8:
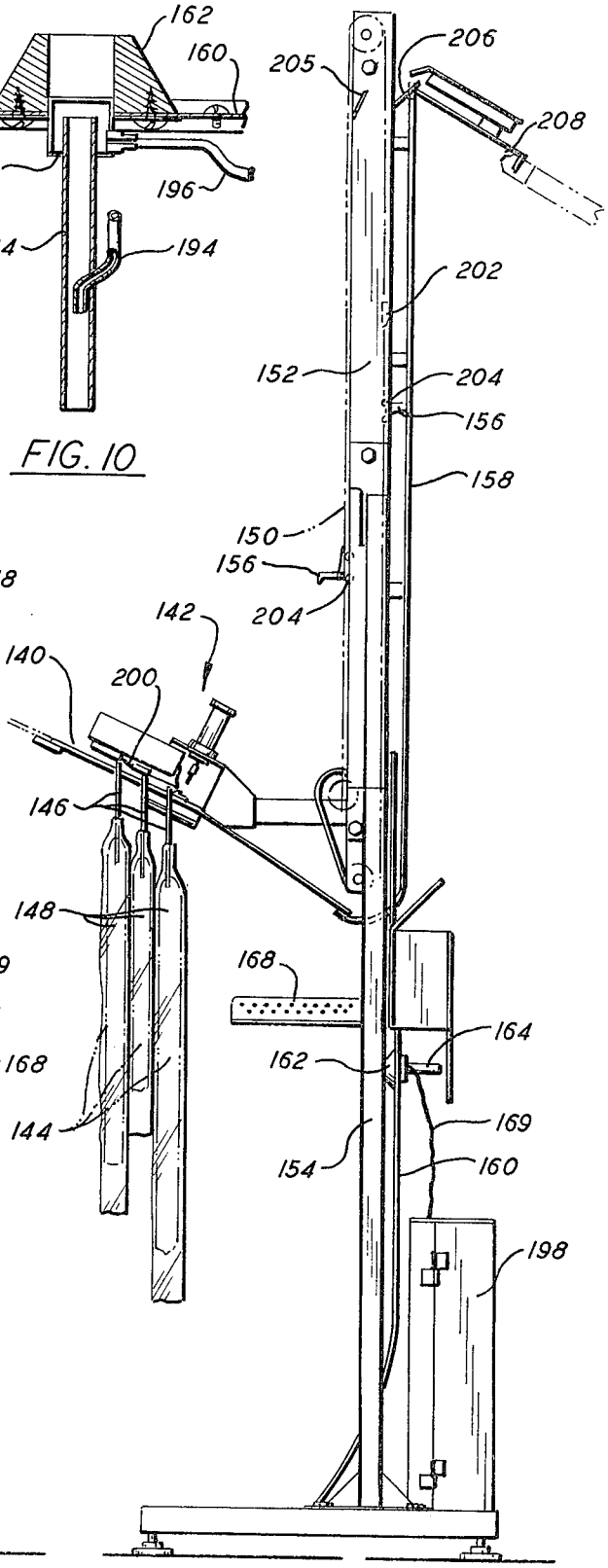
Figure 9:
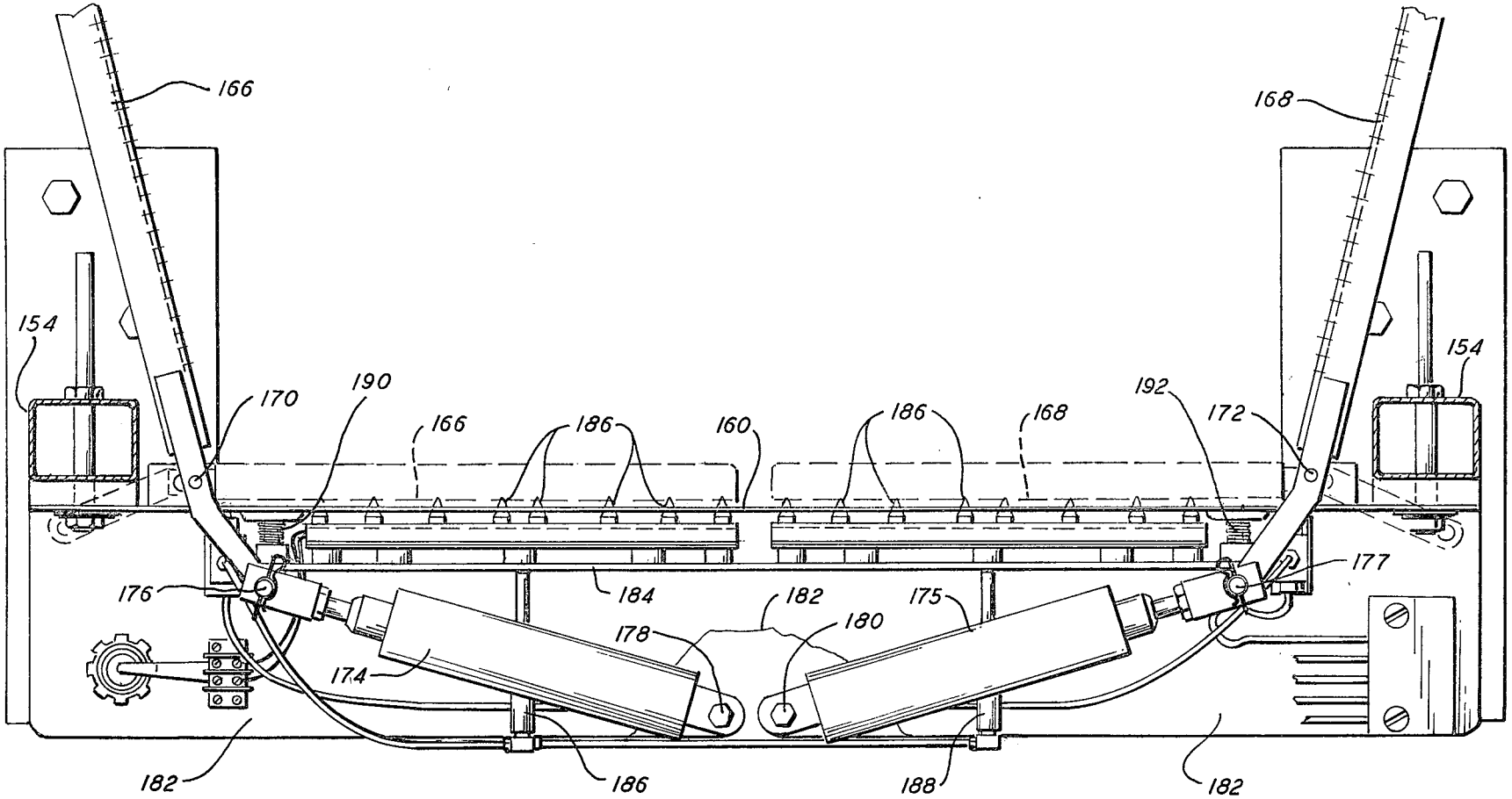

A pair of clamping arms 166 and 168 are mounted for pivotal movement about pins 170 and 172, respectively, as seen in FIG. 9. The ends of the extensible and retractable piston rods of air cylinders 174 and 175 are connected at 176 and 177 to extensions of clamping arms 166 and 168, respectively, to effect pivotal movement thereof between open positions, shown in FIG. 8 and in solid lines in FIG. 9, and closed positions, shown in FIG. 7 and in dotted lines in FIG. 9. Cylinders 174 and 176 are pivotally mounted at 178 and 180 upon plate 182 which is affixed to frame 154, only fragments of plate 182 being shown in FIG. 9 in order to show other portions of the apparatus more clearly.

Support plate 184 is fixedly mounted on the ends of extensible and retractable piston rods of a second pair of pneumatic cylinders 186 and 188 which are likewise mounted upon plate 182. As in the earlier described embodiment, support plate 184 carries a pair of electrical resistance heating elements having a plurality of conical prongs 186 extending therefrom. Extension of cylinders 186 and 188 moves support plate 184 toward plate 160, guided upon fixed pins surrounded by coil springs 190 and 192, to the position shown in FIG. 9.

Figure 10:
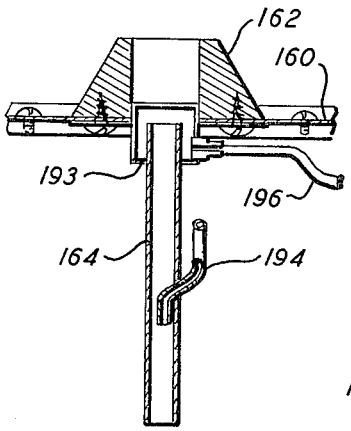
FIGS. 9 and 10 are enlarged, fragmentary, plan views of portions of the apparatus of FIGS. 7 and 8 in section on the lines 9—9 and 10—10, respectively, of FIG. 7.

Referring now to FIG. 10, member 162 is shown in enlarged cross-section with tube 164, open at both ends, supported by plate 193 with one of its ends positioned directly within the opening in plate 160 surrounded by the aperture in member 162. Air under pressure is provided through tube 194 for exhaust through the end of the tube 164 remote from member 162, thereby aspirating air from the forward end of the tube through the aperture in member 162. Tube 196 communicates at one end with the space surrounding the forward end of tube 164, as seen in FIG. 10, and at the other end with a pressure-responsive switch in control cabinet 198 (FIG. 8). Thus, when the aperture defined by member 162 is covered by one of bags 148 the pressure in the space with which tube 196 communicates will be lower than when the aperture is uncovered and the switch will be actuated by the presence or non-presence of a bag in covering relation to the aperture.

Since desgin of appropriate power supply and logic circuitry for the present embodiment of the apparatus will be apparent to those skilled in the art from an explanation of its operation, taken with the disclosure of the circuitry of the previously described embodiment, no specific discussion thereof is required. Manually operable switches are provided in control cabinet 198 for connecting motor 155 and the heating elements for prongs 186 directly across the AC supply. The switching and logic circuitry is operated on DC, as before. Supply of hangers to the apparatus for pickup by fingers 156 is, as previously mentioned, controlled by sequential feed mechanism 142. The latter is triggered to allow a single hanger to pass the stop means in response to the simultaneous closing of two switches, wired in series. The switches have movable contacts, one connected to arm 200 and the other to a movable portion of microswitch 202, both of which are seen in FIG. 8. Arm 200 is positioned in advance of the hanger stop means of feeder mechanism 142 and held in the raised position to close the associated switch only when a predetermined number of hangers (e.g., three) are present behind the stop means. Associated with each of the two fingers 156 on conveyor chain 150 are rollers 204 which contact the movable portion of microswitch 202 each time one of the fingers passes, thereby momentarily closing the switch contacts. Thus, when at least the minimum required number of hangers is present to hold arm 200 in the upper position, feeder mechanism 142 will be actuated to allow a single hanger to pass the stop means each time one of rollers 204 contacts microswitch 202. The hanger hook will slide to the bottom of rail 140 and be picked up by the next finger 156 to pass around the lower end of the conveyor.

Figure 7:
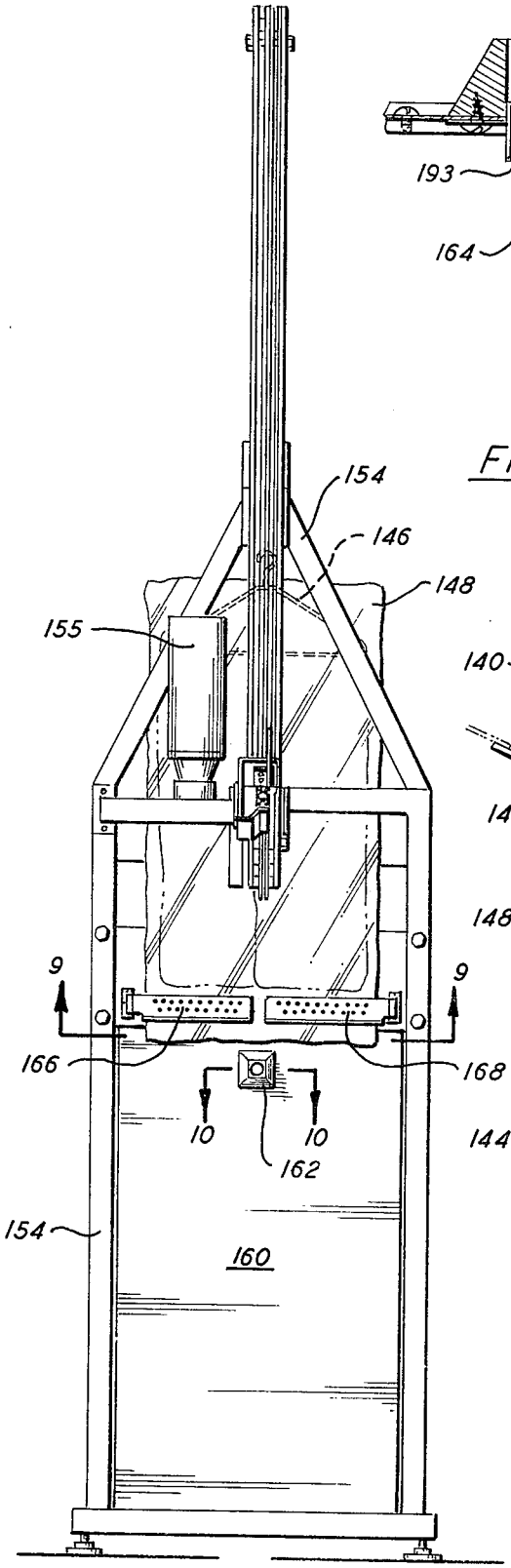
FIGS. 7 and 8 are front, and side elevational views, respectively, of another embodiment of the bottom sealer apparatus.

At this point, clamping arms 166 and 168 are in the open position, as in FIG. 8, and prongs 186 are retracted to the rear side of plate 160. Logic circuitry similar to that of FIG. 6 is provided for actuation of the clutch and brake associated with motor 155 and of the solenoid operated valves controlling the supply of pressurized air to the pneumatic cylinders. As the hanger hook is picked up by finger 156, the material of the associated bag 148 covers the aperture in member 162, thereby opening the associated pressure-responsive switch in the manner previously described. The logic circuitry is then reset by rollers 204 contacting insulated plate 205 and moving it into grounding engagement with a portion of frame 152. Closing of the pressure switch upon movement of the lower edge of the bagging material past the aperture in member 162 serves to actuate the clutch and brake, thereby stopping conveyor chain 150, and the valve controlling air supply to cylinders 174 and 175, thereby moving clamping arms 166 and 168 from the open to the closed position. Operation of the clutch, brake and air valve is such that the conveyor chain, and thereby the hanger, garment and bag, is stopped and the clamping arms closed with the lower end of the bag, near the bottom edge thereof, held firmly between the clamping arms and plate 160, as shown in FIG. 7.

The valve controlling air supply to cylinders 186 and 188 is then actuated to move prongs 186 through the openings in plate 160 and the bagging material to effect sealing of the two layers thereof in the same manner as in the first embodiment. A time delay between operation of cylinders 174 and 175 to clamp the bagging material in the area to be sealed and operation of cylinders ane 186 and 188 is provided either electrically or mechanically, and the valve may be actuated by either means, as desired. A timer in the circuit provides a second time delay, after which the valves controlling air supply to all four cylinders are reverse actuated to move clamping arms 166 and 168 back to the open position and retract prongs 186 back to the rear side of plate 160. Also, the brake is released and the clutch engaged to place motor 155 in driving engagement with conveyor chain 150 again. As finger 156 carrying the hanger held garment in a bag which is now completely sealed nears the top of its travel the hanger hook is pushed off the moving finger by stationary finger 206 and deposited on slide rail 208 where it descends by gravity to a conveyor or other pickup station.

What is claimed is:

1. An automated garment bagging method comprising the steps of:

(a) arranging the garment on a hanger having a hook for suspension thereof from a support;

(b) placing the hanger upon a first support for automatic movement along a first predetermined path to a bagging station;

(c) automatically forming a bag of heat sealable material about the garment at said bagging station, said bag being closed at the sides and upper end through which the hanger hook extends, and open at the lower end which extends beyond the lower edge of the garment;

(d) placing the hanger upon a second support for automatic movement along a second predetermined path to a bottom sealing station;

(e) automatically heat sealing said lower end of the bag at said bottom sealing station to effect closure thereof in an area below said lower edge of the garment; and (f) placing the hanger on a third support for automatic movement along a third predetermined path to a pick-up station.

2. The invention according to claim 1 wherein said second and third supports comprise inclined rods and said automatic movement along said second and third paths is by gravity.

3. The invention according to claim 1 wherein said automatic heat sealing is performed automatically in response to the bag reaching a predetermined position with respect to said bottom sealing station.

4. Apparatus for sealing the lower end of a bag supported at its upper end upon a garment hanger with its hook end extending through the sealed upper end of the bag which covers and extends beyond the lower end of a garment likewise supported upon the hanger, said apparatus comprising, in combination:

(a) support means for holding the hanger hook in a predetermined position upon the apparatus;

(b) endless chain conveyor means having extended therefrom at least one member movable to engage a hanger hook in said predetermined position and move the hanger, garment and bag along a predetermined position and move the hanger, garment and bag along a predetermined path;

(c) means for stopping movement of said conveyor means in response to a portion of the bag reaching a predetermined point in said path;

(d) sealing means movable in response to the bag reaching said predetermined point, following operation of said means for stopping conveyor movement, to engage and seal together the two layers of the bag at a position below the lower end of the garment; and (e) means for resuming movement of said conveyor means following operation of said sealing means.

5. The invention according to claim 4 wherein said predetermined path is substantially vertical, said predetermined position being at the lower end thereof.

6. The invention according to claim 4 and further including means for removing the hanger hook from said engagement member at the upper end of said predetermined path.

7. The invention according to claim 4 wherein said sealing means includes a fixed portion, a first portion movable to engage the two layers of the bag at the lower end thereof between said fixed portion and first movable portion, and a second portion movable from a retracted to an extended position to contact and seal together said two layers in the area thereof engaged between said fixed and first movable portions.

8. The invention according to claim 7 wherein said first movable portion comprises a pair of plate members mounted for reciprocating movement toward and away from said fixed portion.

9. The invention according to claim 8 wherein said fixed and first movable portions are each provided with a plurality of openings which are in registration when said first movable portion is in engagement with said bag, and said second movable means comprises a plurality of members which are moved through the openings in said fixed portion, through both layers of the bag, and into the openings in said first movable means as said second movable portion is moved to said extended position thereof.

10. The invention according to claim 9 wherein said pair of plate members are mounted for reciprocal rotating movement about pivotal mountings at the respective ends thereof.

11. The invention according to claim 9 wherein said pair of plate members are mounted for reciprocal linear movement between engaging and disengaging positions with respect to a bag positioned between said plate members and said fixed portion.

12. The invention according to claim 4 and further including an electric motor for driving said conveyor means and an electrical control circuit having switch means actuable to effect said stopping and resuming movement of said conveyor means and movement of said sealing means in response to opening and closing of said switch means.

13. The invention according to claim 12 wherein said switch means includes a switch member opened and closed by movement of the bag material with respect to the apparatus.

14. The invention according to claim 13 wherein said switch member is pressure-responsive and further including a fixed aperture which the bag material covers during a portion of its movement along said predetermined path, said switch member being opened and closed in accordance with the covered and uncovered condition of said aperture.

15. The invention according to claim 13 wherein said switch member comprises a pair of contacts so arranged with respect to one another that the bag material is moved between said contacts, opening said switch member, during a portion of said movement along said predetermined path.

16. The invention according to claim 4 wherein said apparatus further includes a substantially flat bed having a length and width greater than the bags to the handled by the apparatus, and so arranged with respect to said predetermined path that one side of the bag is in contact with said bed during at least a portion of said movement along said predetermined path.

17. The invention according to claim 16 and further including an electrical control circuit having switch means movable to effect said stopping and resuming movement of said conveyor means and initiating movement of said sealing means, said switch means being movable in response to movement of the hanger, garment and bag along said predetermined path.

18. The invention according to claim 17 wherein said switch means includes a pair of normally closed contacts which are opened by movement of the bag therebetween during travel along a portion of said predetermined path.

19. The invention according to claim 18 wherein said bed forms one of said pair of contacts, the other being movable into and out of electrical contact with said bed.

20. The invention according to claim 17 wherein said switch means includes two pairs of normally closed contacts connected in parallel, said bed forming one contact of each pair, the other contacts of the two pairs being movable into and out of electrical contact with said bed by movement of the bag between said bed and said other contacts during travel along a portion of said predetermined path.

* * * * *